US008150288B2

(12) United States Patent
Na et al.

(10) Patent No.: US 8,150,288 B2
(45) **Date of Patent: *Apr. 3, 2012**

(54) APPARATUS AND METHOD OF CONTROLLING POWER SUPPLY TO HEATING ROLLER AND PHASE CONTROL CIRCUIT CORRESPONDING TO THE APPARATUS AND METHOD

(75) Inventors: Tae-kwon Na, Seoul (KR); Young-min Chae, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/978,941

(22) Filed: Dec. 27, 2010

(65) Prior Publication Data

US 2011/0091233 A1 Apr. 21, 2011

Related U.S. Application Data

(63) Continuation of application No. 11/684,804, filed on Mar. 12, 2007, now Pat. No. 7,885,567.

(30) Foreign Application Priority Data

Mar. 14, 2006 (KR) ..... 2006-23568

(51) Int. Cl.
*G03G 15/20* (2006.01)

(52) U.S. Cl. ..... 399/69; 399/67; 399/320

(58) Field of Classification Search ..... None
See application file for complete search history.

(56) References Cited

U.S. PATENT DOCUMENTS

| | | | | |
|---|---|---|---|---|
| 3,743,954 | A | 7/1973 | Snedkerud | |
| 4,328,459 | A | 5/1982 | McLeod, Jr. | |
| 5,376,773 | A * | 12/1994 | Masuda et al. | 219/543 |
| 6,853,818 | B2 * | 2/2005 | Nishida | 399/67 |

FOREIGN PATENT DOCUMENTS

| | | |
|---|---|---|
| EP | 883246 | 12/1998 |
| EP | 1054503 | 11/2000 |
| EP | 1612934 | 1/2006 |
| EP | 1811345 | 7/2007 |
| JP | 58-84317 | 5/1983 |
| JP | 2003-149982 | 5/2003 |
| JP | 2003-173104 | 6/2003 |
| JP | 2003-195680 | 7/2003 |
| KR | 2004-99635 | 12/2004 |

* cited by examiner

*Primary Examiner* — David Gray
*Assistant Examiner* — Roy Y Yi
(74) *Attorney, Agent, or Firm* — Stanzione & Kim, LLP

(57) ABSTRACT

A method and an apparatus to control power supplied to a heating roller and a phase control circuit corresponding to the method or the apparatus. The phase control circuit may include an examination unit to compare levels of a sine wave having a predetermined first period and a switching signal to increase and decrease repeatedly according to a predetermined second period, and a phase control signal generation unit to generate a phase control signal having a non-zero in intervals of time sections including a time when levels of the switching signal and the sine wave which is in a decreasing section are equal to each other during a time period when the level of the sine wave is zero, and a time when levels of the switching signal and the sine wave which is in an increasing section are equal to each other during a time period when the level of the sine wave is zero.

19 Claims, 10 Drawing Sheets

APPARATUS AND METHOD OF CONTROLLING POWER SUPPLY TO HEATING ROLLER AND PHASE CONTROL CIRCUIT CORRESPONDING TO THE APPARATUS AND METHOD

CROSS-REFERENCE TO RELATED APPLICATIONS

This is a Continuation Application of prior application Ser. No. 11/684,804, filed Mar. 12, 2007 now U.S. Pat. No. 7,885,567, in the U.S. Patent and Trademark Office, which claims priority under 35 U.S.C. §119(a) Korean Patent Application No. 10-2006-0023568, filed on Mar. 14, 2006, in the Korean Intellectual Property Office, the disclosures of which are incorporated herein in their entirety by reference.

BACKGROUND OF THE INVENTION

1. Field of the Invention

The present general inventive concept relates to a heating roller to fix a toner image, and more particularly, to an apparatus and a method of controlling power supply to a heating roller in which external source power is supplied to a heating resistor included in the heating roller and a phase control circuit usable with the apparatus and method.

2. Description of the Related Art

In a printing device, such as a printer or a copy machine, which forms an image of print data on a printing medium by using a developing material such as toner, a toner image corresponding to the print data is fixed onto the printing medium, and the printing medium is then discharged out of the printing device, thereby obtaining the image of the print data.

The printing device may use a heating roller having heating resistors.

To perform a fixing operation, a surface temperature of the heating roller has to be maintained around a fixing target temperature, for example, 180° C.

The printing device is switched to a print mode when the printing device receives a first printing order after power turns on, or when the printing apparatus receives a printing order while in a stand-by mode.

A time interval between when the printing order is received and before a first printed matter is discharged is referred to as a first print out time (FPOT). In order to reduce the FPOT of the printing apparatus including the heating roller, the surface temperature of the heating roller has to rapidly reach a fixing target temperature.

FIGS. 1A and 1B are diagrams of waveforms illustrating a conventional method of controlling power supplied to a conventional heating roller. If a resistance of a heating resistor is determined in proportion to a temperature of the heating roller while the temperature is equal to or lower than a critical temperature, and a voltage (Vin) 110 shown in FIG. 1A is applied to the heating resistor, then a current (Ir) 120 shown in FIG. 1B flows through the heating resistor.

If the current (Ir) 120 is gradually decreased until the temperature of the heating roller reaches the critical temperature, the conventional method of controlling power supplied to the heating roller has a drawback in that a circuit may be damaged due to excessive current which may flow through the heating resistor when power is initially supplied to the heating resistor. In addition, as a result of a high current flowing through the heating roller in the form of an alternating current, a flicker characteristic is reduced. The flicker characteristic is defined as a phenomenon where power supplied to adjacent circuits is temporarily weakened.

A critical resistance that represents a resistance of a heating resistor at a critical temperature is determined intrinsically. Here, the lower the critical resistance of a used heating resistor is, the more power can be supplied to the heating resistor. Thus, the surface temperature of the heating rollers can be rapidly increased. However, when a heating resistor having a lower critical resistance is used, a higher current will flow through the heating resistor when power is initially supplied to the heating resistor, thereby causing the problems described above. Accordingly, in the conventional method of controlling power supply to a heating roller, a heating resistor having a low critical resistance, that is, a level of resistance not low enough to maximize the power supply to the heating resistor is used, and thus, there is a limitation in reducing the time required for increasing a surface temperature of the heating roller up to a fixing target temperature.

Furthermore, if the printing device receives a printing order immediately after the printing apparatus turns on, the heating roller can be heated only after the printing apparatus, more specifically, a control unit (not illustrated) which controls overall tasks performed in the printing apparatus, for example, a central processing unit (CPU) of the printing apparatus, is initialized. Therefore, the aforementioned problem of having a limitation in reducing a warm-up time during a printing preparation becomes more apparent when the printing apparatus receives the printing order before the initialization of the control unit (not illustrated) is completed.

SUMMARY OF THE INVENTION

The present general inventive concept provides a phase control circuit to generate a phase control signal of which an occupancy rate of an active signal interval within a predetermined interval gradually increases.

The present general inventive concept also provides an apparatus to control power supply to a heating roller capable of reducing a flicker characteristic and reaching a fixing target temperature quickly by heating the heating roller before an initialization process of a printing apparatus is completed when the power of the printing apparatus turns on and increasing the power supplied to the heating roller gradually and supplying a maximum power deliverable after a predetermined time elapses.

The present general inventive concept also provides a method of controlling power supply to a heating roller performed in a printing apparatus.

The present general inventive concept also provides a computer readable medium having embodied thereon a computer program to perform a method of controlling roller power being supplied to a heating resistor included in a heating roller in a printing apparatus.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a phase control circuit including an examination unit to compare levels of a sine wave having a predetermined first period and a switching signal that increases and decreases repeatedly according to a predetermined second period, and a phase control signal generation unit to generate a phase control signal that has a non-zero in intervals of time sections including a time when levels of the switching signal and the sine wave which is in a decreasing section are equal to each other during a time period when the level of the sine wave is zero, and also including a time when levels of the switching signal and the sine wave which is in an increasing section are equal to each other during a time period when the level of the sine wave is zero.

The foregoing and/or other aspects and utilities of the present general inventive concept may also be achieved by providing a power control apparatus to control roller power being supplied to a heating resistor included in a heating roller in a printing apparatus to employ a phase control circuit and the heating roller to fix a toner image, the apparatus including a power supply unit to output source power input from an external source to the heating resistor as the roller power while gradually increasing a maximum level of the source power in response to a first or second warm-up indication signal and the phase control signal and outputting the source power having a predetermined maximum supply level as a maximum level to the heating resistor as the roller power in response to a third warm-up indication signal, a temperature measuring unit to measure a surface temperature of the heating roller in response to the third warm-up indication signal and to output the measured surface temperature, a toner fixing unit to fix a toner image of provided print data onto a print medium using the heating roller in response to a fixing indication signal, a first examination unit to compare the increased maximum level input from the power supply unit to the maximum supply level and generating the second or third warm-up indication signal based on a result of the comparison performed by the first examination unit, and a second examination unit to compare the measured surface temperature to a predetermined fixing target temperature and to generate the third warm-up indication signal or the fixing indication signal based on a result of the comparison performed by the first examination unit, wherein the first warm-up indication signal is generated immediately after the printing apparatus turns on, or immediately after the printing apparatus is switched into a print mode from a stand-by mode, and wherein at least one of the examination unit and the phase control signal generation unit is operated in response to the first or second warm-up indication signal.

The foregoing and/or other aspects and utilities of the present general inventive concept may also be achieved by providing a method of controlling roller power being supplied to a heating resistor included in a heating roller in a printing apparatus to employ a phase control circuit and the heating roller to fix a toner image, the method including supplying source power supplied from an external source to the heating resistor as the roller power while gradually increasing a maximum level of the source power up to a predetermined maximum supply level, measuring a surface temperature of the heating roller and supplying the source power having the maximum supply level as a maximum level to the heating resistor until the measured surface temperature reaches a predetermined fixing target temperature and fixing a toner image of provided print data onto a print medium using the heating roller, wherein the supplying of the source power begins to perform immediately after the printing apparatus turns on, or immediately after the printing apparatus is switched to a print mode from a stand-by mode.

The foregoing and/or other aspects and utilities of the present general inventive concept may also be achieved by providing a computer readable medium having embodied thereon a computer program to perform a method of controlling roller power being supplied to a heating resistor included in a heating roller in a printing apparatus to employ a phase control circuit and the heating roller to fix a toner image, the method including supplying source power supplied from an external source to the heating resistor as the roller power while gradually increasing a maximum level of source power up to a predetermined maximum supply level, measuring a surface temperature of the heating roller and supplying the source power having the maximum supply level as a maximum level to the heating resistor as the roller power until the measured surface temperature reaches a predetermined fixing target temperature, and fixing a toner image of provided print data onto a print medium using the heating roller, wherein the supplying of the source power begins to perform immediately after the printing apparatus turns on, or immediately after the printing apparatus is switched to a printing mode from a stand-by mode.

The foregoing and/or other aspects and utilities of the present general inventive concept may also be achieved by providing a control unit to control operations of a printing apparatus, the control unit including a heating control unit that is configured to control a heating operation of a heating roller of the printing apparatus, a non-heating control unit that is configured to control operations of a printing apparatus that are not related to heating of the heating roller, and wherein the heating of the heating roller starts before an initialization process of the non-heating control unit has been completed.

The foregoing and/or other aspects and utilities of the present general inventive concept may also be achieved by providing an image forming device, including a phase control circuit to compare levels of a sine wave that has a predetermined first period and a switching signal that increases and decreases repeatedly according to a predetermined second period, and to generate a phase control signal that has a non-zero value in intervals of time sections including a time when levels of the switching signal and the sine wave which is in a decreasing section are equal to each other during a time period when the level of the sine wave is zero, and also including a time when levels of the switching signal and the sine wave which is in an increasing section are equal to each other during a time period when the level of the sine wave is zero.

The foregoing and/or other aspects and utilities of the present general inventive concept may also be achieved by providing an image forming device, including a power control apparatus to output source power input from an external source to a heating resistor as roller power while gradually increasing a maximum level of the source power in response to a first or second warm-up indication signal and the phase control signal and to output the source power having a predetermined maximum supply level as a maximum level to the heating resistor as the roller power in response to a third warm-up indication signal, to measure a surface temperature of a heating roller in response to the third warm-up indication signal and to output the measured surface temperature, to fix a toner image of provided print data onto a print medium using the heating roller in response to a fixing indication signal, to compare the increased maximum level input from the power supply unit to the maximum supply level and to generate the second or third warm-up indication signal based on a result of the performed comparison, and compare the measured surface temperature to a predetermined fixing target temperature and to generate the third warm-up indication signal or the fixing indication signal based on a result of the performed comparison, wherein the first warm-up indication signal is generated immediately after the printing apparatus turns on, or immediately after the printing apparatus is switched into a print mode from a stand-by mode.

The foregoing and/or other aspects and utilities of the present general inventive concept may also be achieved by providing an image forming device, including a phase control circuit to compare levels of a sine wave that has a predetermined first period and a switching signal that increases and decreases repeatedly according to a predetermined second period, and to generate a phase control signal that has a non-zero value in intervals of time sections including a time when levels of the switching signal and the sine wave which is in a decreasing section are equal to each other during a time period when the level of the sine wave is zero, and also including a time when levels of the switching signal and the sine wave which is in an increasing section are equal to each other during a time period when the level of the sine wave is zero; and a power control apparatus to output source power input from an external source to a heating resistor as roller power while gradually increasing a maximum level of the source power in response to a first or second warm-up indication signal and the phase control signal and to output the source power having a predetermined maximum supply level as a maximum level to the heating resistor as the roller power in response to a third warm-up indication signal, to measure a surface temperature of a heating roller in response to the third warm-up indication signal and to output the measured surface temperature, to fix a toner image of provided print data onto a print medium using the heating roller in response to a fixing indication signal, to compare the increased maximum level input from the power supply unit to the maximum supply level and to generate the second or third warm-up indication signal based on a result of the performed comparison, and compare the measured surface temperature to a predetermined fixing target temperature and to generate the third warm-up indication signal or the fixing indication signal based on a result of the performed comparison, wherein the first warm-up indication signal is generated immediately after the printing apparatus turns on, or immediately after the printing apparatus is switched into a print mode from a stand-by mode.

The foregoing and/or other aspects and utilities of the present general inventive concept may also be achieved by providing a method of controlling roller power being supplied to a heating resistor included in a heating roller in a printing apparatus to employ a phase control circuit, the method including comparing levels of a sine wave that has a predetermined first period and a switching signal that increases and decreases repeatedly according to a predetermined second period, and generating a phase control signal that has a non-zero value in intervals of time sections including a time when levels of the switching signal and the sine wave which is in a decreasing section are equal to each other during a time period when the level of the sine wave is zero, and also including a time when levels of the switching signal and the sine wave which is in an increasing section are equal to each other during a time period when the level of the sine wave is zero.

The foregoing and/or other aspects and utilities of the present general inventive concept may also be achieved by providing a computer readable medium having embodied thereon a computer program to perform a method of controlling roller power being supplied to a heating resistor included in a heating roller in a printing apparatus to employ a phase control circuit, the method including comparing levels of a sine wave that has a predetermined first period and a switching signal that increases and decreases repeatedly according to a predetermined second period, and generating a phase control signal that has a non-zero value in intervals of time sections including a time when levels of the switching signal and the sine wave which is in a decreasing section are equal to each other during a time period when the level of the sine wave is zero, and also including a time when levels of the switching signal and the sine wave which is in an increasing section are equal to each other during a time period when the level of the sine wave is zero.

The foregoing and/or other aspects and utilities of the present general inventive concept may also be achieved by providing a phase control circuit, including a switching signal generation unit to synchronize a switching signal with a sine wave, an examination unit to compare levels of the switching signal and the sine wave, and to produce a comparison signal corresponding to the compared levels, a pulse signal generation unit to output a pulse signal when the comparison signal enters into a non-signal interval from a signal interval, and a phase control generation unit to generate a phase control signal which has a signal in an interval from a point of time when the level of the switching signal matches the level of the sine wave.

The switching signal generation unit may synchronize the switching signal and the sine wave by opening or closing a switch when a level of the sine wave is zero.

The examination unit may further detect an interval during which the level of the sine wave is higher than the level of the switching signal, and outputs the comparison signal which has a signal interval the same as the detected interval.

The pulse signal generation unit may output a pulse signal when the comparison signal enters into the signal interval from the non-signal interval.

The phase control generation unit may further generate the phase control signal based on a result of the comparison of a point of time when the level of the sine wave is zero and an interval from a point of time when the level of the switching signal matches the level of the sine wave, and output the generated phase control signal.

The foregoing and/or other aspects and utilities of the present general inventive concept may also be achieved by providing a method of controlling roller power being supplied to a heating resistor included in a heating roller in a printing apparatus to employ a phase control circuit, the method including synchronizing a switching signal with a sine wave comparing levels of the switching signal and the sine wave, and producing a comparison signal corresponding to the compared levels outputting a pulse signal when the comparison signal enters into a non-signal interval from a signal interval, and generating a phase control signal which has a signal in an interval from a point of time when the level of the switching signal matches the level of the sine wave.

The switching signal with the sine wave may be synchronized by opening or closing a switch when a level of the sine wave is zero.

The comparing of the levels of the switching signal and the sine wave may further include detecting an interval during which the level of the sine wave is higher than the level of the switching signal, and outputting a comparison signal which has a signal interval the same as the detected interval.

The outputting of the pulse signal may further include outputting a pulse signal when the comparison signal enters into the signal interval from the non-signal interval.

The generation of the phase control signal may be based on a result of the comparison of a point of time when the level of the sine wave is zero and an interval from a point of time when the level of the switching signal matches the level of the sine wave.

The foregoing and/or other aspects and utilities of the present general inventive concept may also be achieved by providing a computer readable medium having embodied thereon a computer program for the method of controlling roller power being supplied to a heating resistor included in a heating roller in a printing apparatus to employ a phase control circuit, the method including synchronizing a switching signal with a sine wave, comparing levels of the switching signal and the sine wave, and producing a comparison signal corresponding to the compared levels, outputting a pulse signal when the comparison signal enters into a non-signal interval from a signal interval, and generating a phase control signal which has a signal in an interval from a point of time when the level of the switching signal matches the level of the sine wave.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figures 1A, 1B:
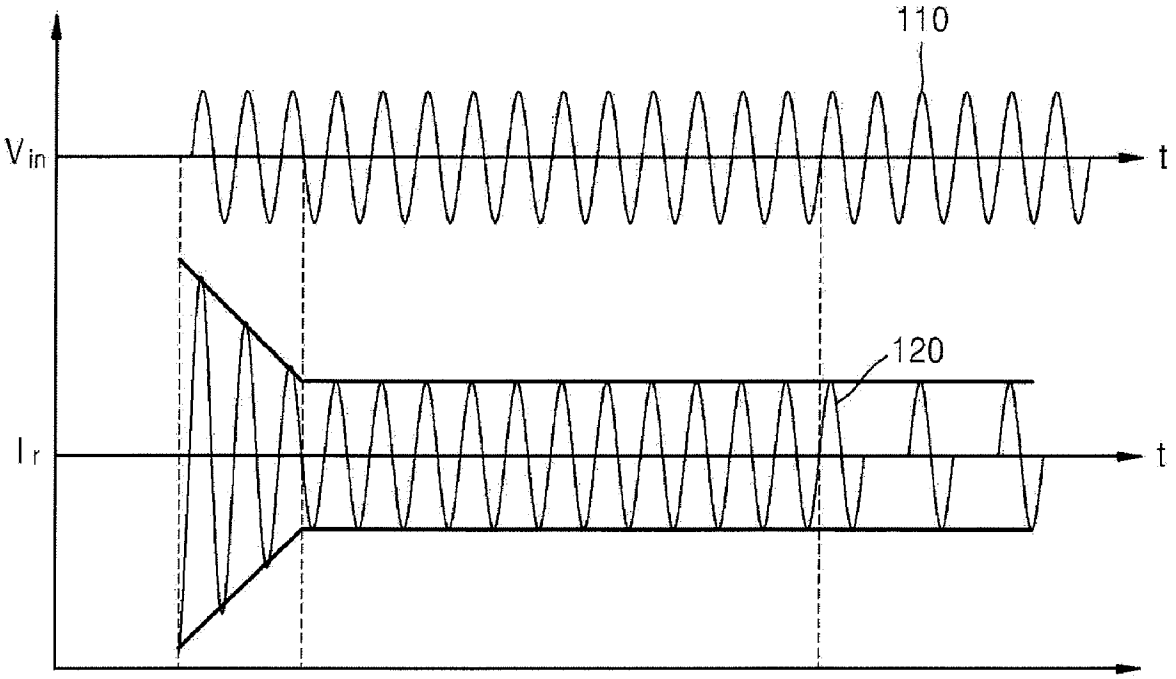
FIG. 1A (RELATED ART)
FIG. 1B (RELATED ART)
FIGS. 1A and 1B are waveform diagrams illustrating a conventional method of controlling power supplied to a conventional heating roller.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
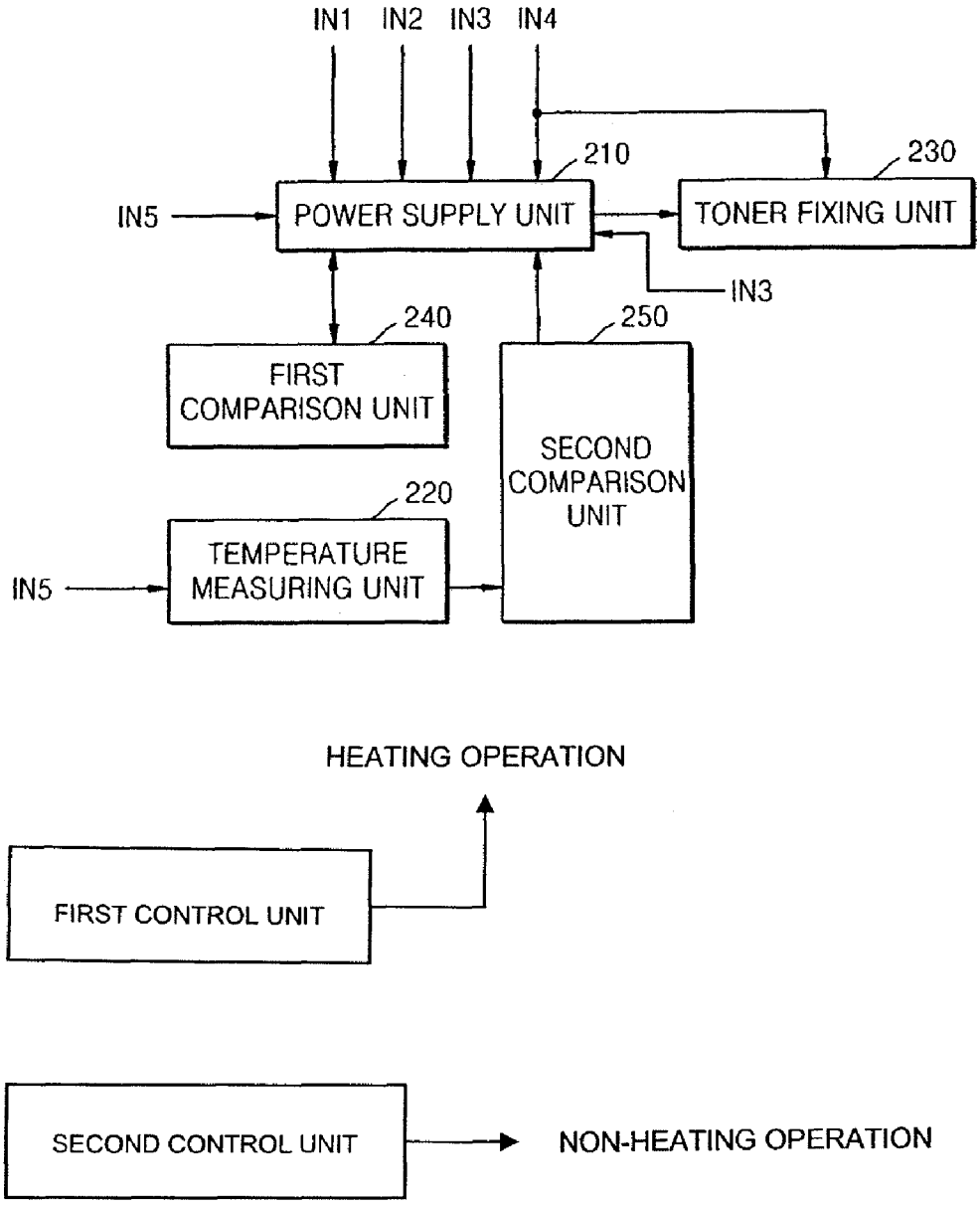
FIG. 2 is a block diagram illustrating an apparatus to control power supplied to a heating roller according to an embodiment of the present general inventive concept.

FIG. 2 is a block diagram illustrating a power control apparatus to control a power supplied to a heating roller usable in a printing apparatus or an image forming apparatus according to an embodiment of the present general inventive concept. The power control apparatus includes a power supply unit 210, a temperature measuring unit 220, a toner fixing unit 230, a first examination (e.g., comparison) unit 240, and a second examination (e.g. comparison) unit 250.

The units 210 through 250 of the power control apparatus may be installed in a printing apparatus to fix a toner image such as a fixing system of a laser printer or a copy machine. The printing apparatus may include a heating roller having one or more lamps. The toner fixing unit may include the heating roller and other rollers to transfer a printing medium or fix a toner image of the printing medium using the heating roller and the other rollers, and the toner fixing unit 230 may be included in the printing apparatus.

Each lamp includes a heating resistor. The heating resistor may be made of tungsten or a similar material, and may have a variable characteristic whereby a resistance is determined in proportion to, or inversely proportional to, a temperature of the heating resistor. When the resistance is in proportion to the temperature of the heating resistor below a critical temperature, the heating resistor is determined to have a characteristic of a positive temperature coefficient (PTC). Accordingly, the heating resistor is assumed to have the characteristic of the positive temperature coefficient.

A plurality of lamps (i.e., a plurality of heating resistors), included in the heating roller may be connected in parallel. A roller power, that is, a power supplied to the heating resistors, may be controlled to correspond to each resistor independently.

The roller power is supplied to the heating resistors in a form of an alternating current (AC), since roller voltages and roller currents are AC. The roller voltages may indicate voltages applied to the heating resistors or currents flowing through the heating resistors.

The power supply unit 210 outputs source power to the heating resistors as the roller power while gradually increasing a maximum level of the source power in response to first warm-up indication and phase control signals or second warm-up indication and phase control signals. In addition, the power supply unit 210 may output the source power to the heating resistors without changing the maximum level of the source power in response to a third warm-up indication signal or a fixing indication signal. The source power indicates power input to the power supply unit 210 from outside the heating resistors and the power supply unit 210, and the roller power indicates power supplied to the heating resistors by the power supply unit 210. Accordingly, the source power is input through an input terminal IN6.

The temperature measuring unit 220 detects a temperature of a surface of the heating roller in response to the third warm-up indication signal and outputs the detected temperature of the surface.

The toner fixing unit 230 feeds a print medium to the heating roller in response to the fixing indication signal and fixes a toner image corresponding to print data provided to the printing apparatus on the fed print medium. Here, the print data includes one or more sheets. Toner images are printed on pages of print media, respectively, and the print media on which the toner images are fixed are ejected externally from the printing apparatus as printed material.

The first, second, and third warm-up indication signals, the phase control signal and the fixing indication signal described above will now be described in detail.

The first warm-up indication signal is input through an input terminal IN1. The first warm-up indication signal denotes a signal according to which the power supply unit 210 increases the maximum level of the input source power and provides the input source power having an increased maximum supply level to the heating resistor as the roller power. The first warm-up signal is generated immediately after the printing apparatus is turned on or immediately after the printing apparatus shifts into a printing mode from a stand-by mode. To generate the first warm-up signal, a first control unit (not illustrated) to control heating related operations of the printing apparatus, hereinafter referred to a heating control unit, and a second control unit (not illustrated), hereinafter referred to a non-heating control unit, to control all operations other than the heating-related operations, hereinafter referred to as non-heating related operations, are separately configured in the printing apparatus. Accordingly, the heating related operations denote operations that have a relevance equal to or greater than a predetermined relevance to the heating operation. The predetermined relevance may be set as high as possible.

For example, the heating control unit may recognize the heating roller, or control heating of the heating roller. The first warm-up indication signal may be generated by the heating control unit. In contrast, the non-heating control unit may recognize a pressure roller, or control rotational operations of the heating roller and a pressure roller, or control a laser scanning unit (LSU) included in the printing apparatus.

The non-heating control unit may correspond to a central processing unit (CPU) of the printing apparatus. Accordingly, the CPU controls all operations of the printing apparatus except operations related to heating.

As described above, a control unit to control operations of the printing apparatus may include the heating control unit and the non-heating control unit, which are separately configured. Accordingly, heating of the heating roller of the printing apparatus can start even before an initialization process of the CPU has been completed. This differs from a conventional method of power control in which operations related to heating can begin only after an initialization of the printing apparatus, more specifically, the initialization of the CPU, has been completed, when the printing apparatus turns on.

The heating and non-heating control units can be implemented as hardware or software.

The second warm-up indication signal is input through an input terminal IN2. The second warm-up indication signal denotes a signal according to which the power supply unit 210 may increase or maintain the maximum supply level of the input source power, and the source power that has an increased maximum supply level may be supplied to the heating resistor. The second warm-up indication signal is generated by a first examination unit 240.

The phase control signal is input through an input terminal IN3. The phase control signal is a signal to instruct the power supply unit 210 to supply the source power to the heating resistor as the roller power during a predetermined second time period within a predetermined first time period. The phase control signal is generated by the heating control unit in response to the first warm-up indication signal or the second warm-up indication signal. Accordingly, the power supply unit 210 which operates in response to the first warm-up indication signal or the second warm-up indication signal supplies the source power to the heating resistor during the predetermined second time as the roller power. Here, the predetermined second time is equal to or less than the predetermined first time, and the predetermined second time increases as a maximum level of the source power approaches the maximum supply level.

The third warm-up indication signal is input through an input terminal IN4. The third warm-up indication signal denotes a signal according to which the power supply unit 210 supplies the source power having a maximum supply level to the heating resistor as the roller power. The third warm-up indication signal may be generated by the first examination unit 240 or the second examination unit 250.

The fixing indication signal is input through an input terminal IN5. The fixing indication signal denotes a signal according to which the power supply unit 210 supplies the source power having a maximum temperature maintaining level to the heating resistor as the roller power. The fixing indication signal is generated by the second examination unit 250 or by the heating control unit while fixing is performed.

A generation method of the second and third warm-up indication signals and the fixing indication signal will now be described with description of operations of the first and second examination units 240 and 250.

The first examination unit 240 compares the increased maximum level input from the source supply unit 210 to a predetermined maximum supply level and generates the second or third warm-up indication signal based on a result of the comparison. Accordingly, the maximum supply level may be a maximum level of the roller power which can be supplied to the heating resistor.

If the increased maximum level input from the power supply unit 210 is determined to be less than the maximum supply level according to the comparison result, the first examination unit 240 may generate the second warm-up indication signal. In contrast, when the increased maximum level input from the power supply unit 210 is determined to have reached the maximum supply level according to the comparison result, the first examination unit 240 generates the third warm-up indication signal.

The second examination unit 250 compares a measured surface temperature of the heating roller measured by the temperature measuring unit 220 to a target fixing temperature, for example, 180 degree centigrade, and generates the third warm-up indication signal or the fixing indication signal based on a result of the comparison. Accordingly, the target fixing temperature denotes the surface temperature of the heating roller at which a toner image can be fixed in a stable manner. The surface temperature of the heating roller at which the toner image can be stably fixed may be an arbitrary temperature equal to or higher than a minimum fixing temperature and equal to or lower than a maximum fixing temperature, and the target temperature may be set between the minimum and maximum fixing temperatures.

More specifically, when the surface temperature that is measured by the temperature measuring unit 220 is determined to be lower than the target fixing temperature based on the result of the comparison, the second examination unit 250 generates the third warm-up indication signal. In contrast, when the surface temperature measured by the temperature measuring unit 220 is determined to have reached the target fixing temperature based on the result of the comparison, the second examination unit 250 generates the fixing indication signal.

The operations of the power supply unit 210, the temperature measuring unit 220, and the first and second examination units 240 and 250 described above may be controlled by the heating control unit and the operation of the toner fixing unit 230 may be controlled by the non-heating control unit when the heating roller is disposed outside the toner fixing unit 230. The heating operations include supplying the source power to the heating rollers and the non-heating operations include fixing the toner image on the printing medium using the heated heating roller and the other parts.

Figures 3A, 3B:
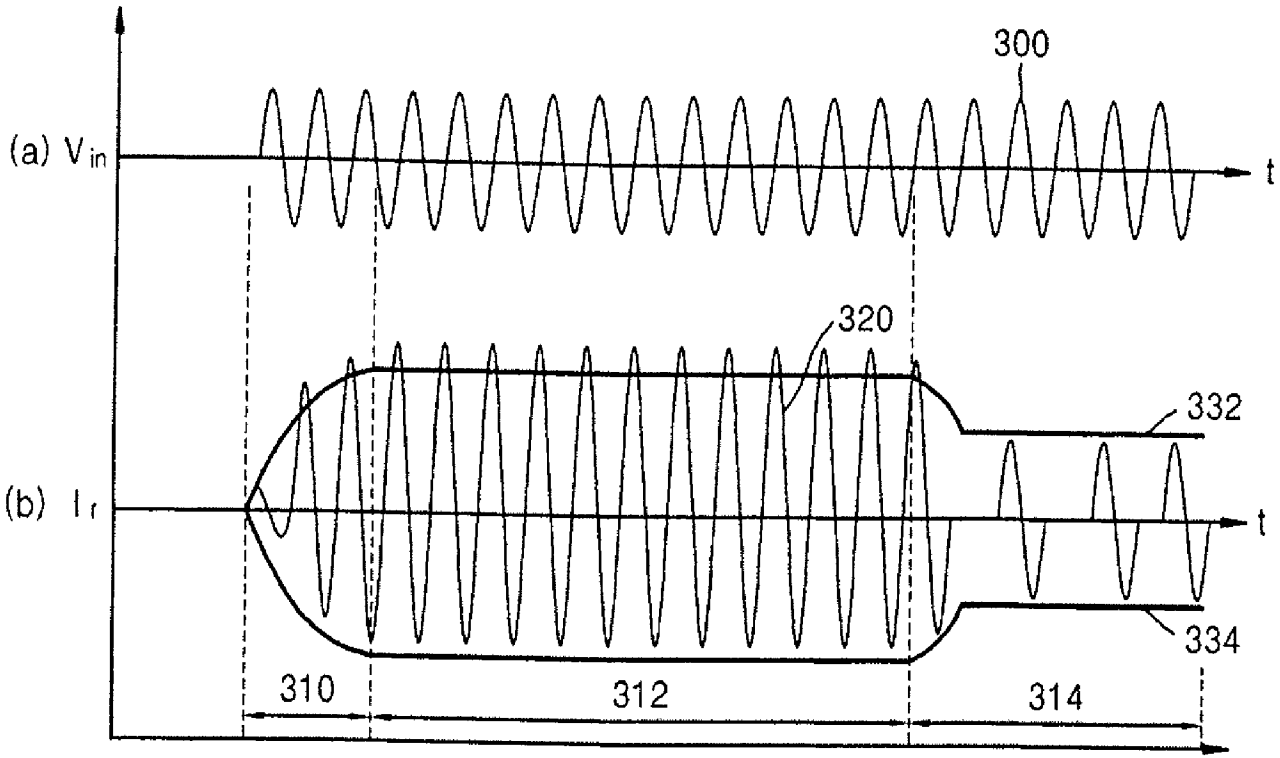
FIGS. 3A and 3B are waveform diagrams illustrating a method of controlling power supplied to a heating roller according to an embodiment of the present general inventive concept.

FIGS. 3A and 3B are waveform diagrams illustrating a principle of controlling power supplied to the heating roller according to an embodiment of the present general inventive concept. As illustrated in FIG. 3A, some or all of a source voltage Vin 300 in a form of a sine wave generated by a source voltage generation unit (not illustrated) is applied to the heating resistor has a proportional temperature characteristic as its roller voltage. Accordingly, a roller current 320 illustrated in FIG. 3B flows through the heating resistor. The power supply unit 210 of FIG. 2 may receive some or all of the source voltage 300 from the source voltage generation unit as an input, and may output the input source voltage 300 to the heating resistor as the roller voltage.

The source voltage 300, the roller voltage, and the roller current 320 have AC waveforms. Accordingly, both the source power and the roller power have AC waveforms as described above. More specifically, envelopes of the source power and the roller power have the same form as a positive envelope 332 of envelopes 332 and 334 of the roller current 320.

A waveform of the roller current 320 flowing through the heating resistor may be divided into three intervals which include a flicker characteristic reduction interval 310, a maximum power supply interval 312, and a settling interval 314.

Referring to FIGS. 2, 3A, and 3B, the flicker characteristic reduction interval 310 indicates a time interval during which the power supply unit 210 operates in response to the first warm-up indication signal and the phase control signal, or in response to the second warm-up indication signal and the phase control signal. In the flicker characteristic reduction interval 310, the power supply unit 210 supplies the source power to the heating resistor as the roller power during the predetermined second time while gradually increasing a maximum level of the source power up to the maximum supply level. As a result, the predetermined second time and a maximum level of the source power are gradually increased during the flicker characteristic reduction interval 310 to reduce the flicker characteristic. The roller voltage that is applied to the heating resistor until the maximum level of the source power reaches the maximum supply level is a portion of the source voltage 300. Phases of the source power my vary according to the phase control signal in the intervals 310, 312, and 314.

The maximum power supply interval 312 indicates a time interval during which the power supply unit 210 operates in response to the third warm-up indication signal. During the maximum power supply interval 312, the power supply unit 210 supplies the source power having the maximum supply level as a maximum level to the heating resistor as the roller power. Accordingly, all of the source voltage 300 is applied to the heating resistor as the roller voltage.

The settling interval 314 denotes a time interval during which the power supply unit 210 and the toner fixing unit 230 operate in response to the fixing indication signal. In the settling interval 314, the power supply unit 210 supplies the source power that has a maximum temperature maintaining level to the heating resistor as the roller power, and the toner fixing unit 230 fixes a toner image on a print medium using a heating roller to which the source power that has the maximum temperature maintaining level is supplied as the roller power. During the settling interval 314, the roller voltage that is applied to the heating resistor represents a portion of the source voltage.

The surface temperature of the heating roller to which the source power that has the maximum temperature maintaining level is supplied is closer than a predetermined similarity to the fixing target temperature. For example, the surface temperature of the heating roller to which the source power having the maximum temperature maintaining level is supplied is in a range of 95% to 105% of the fixing target temperature. Accordingly, the surface temperature of the heating roller to which the source power having the maximum temperature maintaining level is supplied should be between the minimum and maximum fixing temperatures.

If the print data includes a few pages, for example two pages, although the roller power is not supplied to the heating roller which has a surface temperature that has reached the fixing target temperature, the surface temperature may not fall below the minimal fixing temperature until fixing of all toner images corresponding to the print data is completed. Accordingly, unlike in the previous description, the power supply unit 210 may not supply the source power that has the maximum temperature maintaining level to the heating resistor as the roller power, and although the roller power is not supplied additionally, the toner fixing unit 230 can fix toner images in a stable manner.

If the print data includes many pages, for example several tens of pages, when the roller power is not supplied to the heating roller of which the surface temperature has reached the fixing target temperature, the surface temperature may fall below the minimum fixing temperature before fixing of all toner images corresponding to the print data is completed. Accordingly, as described above, the power supply unit 210 should supply the source power that has the maximum temperature maintaining level to the heating resistor as the roller power.

During the flicker characteristic reduction interval 310 and the maximum power supply interval 312, the roller power is supplied to all of the heating resistors included in the heating roller, respectively, but in the settling interval 314, the roller power may be supplied to selected one or more heating resistors from among all the heating resistors.

The selection of heating resistors is performed by the non-heating control unit and the non-heating control unit changes the selection of the heating resistors periodically or non-periodically. Accordingly, in the fixing interval 314, a time frame during which the roller current 320 flows corresponds to a time frame during which the heating resistor is selected by the non-heating control unit.

Figure 4:
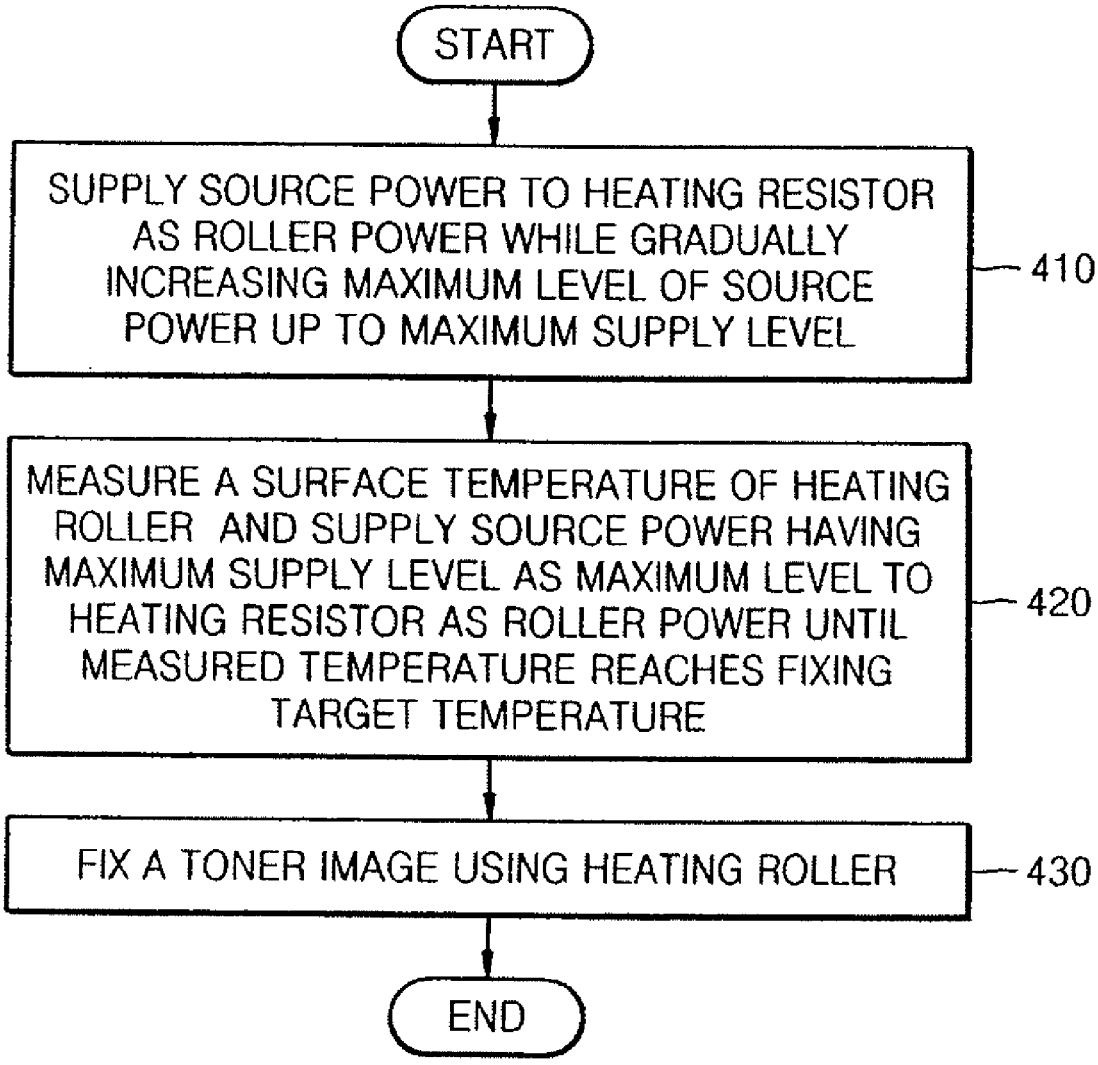
FIG. 4 is a flowchart illustrating a method of controlling power supplied to the heating roller according to an embodiment of the present general inventive concept.

FIG. 4 is a flow chart illustrating a method of power control corresponds to the heating roller according to an embodiment of the present general inventive concept. Referring to FIGS. 2 through 4, the method in the embodiment includes operations 410, 420 and 430 which reduce a flicker characteristic by applying different controlling methods for roller power supplied to a heating resistor in each of the flicker characteristic reduction interval 310, a maximum power supply interval 312, and a fixing interval 314, and enable a surface temperature of the heating roller to reach a fixing target temperature quickly.

The power supply unit 210 supplies the source power to the heating resistor as the roller power while increasing the maximum level of the source power gradually up to the maximum supply level in operation 410. Operation 410 may be performed immediately after the printing apparatus turns on, or immediately after the printing apparatus is switched to a printing mode from a stand-by mode.

After operation 410, the temperature measuring unit 220 measures the surface temperature of the heating roller, and the power supply unit 210 supplies a power source that has the maximum supply level as a maximum level to a heating resistor as roller power until the measured temperature reaches the fixing target temperature in operation 420.

After operation 420, the power supply unit 210 supplies the source power that has the maximum temperature maintaining level to the heating resistor as the roller power, and fixes a toner image of provided print data on a print medium using the heating roller in operation 430.

The operations 410 and 420 described above may be controlled by the heating control unit and the operation 430 may be controlled by the non-heating control unit. The operations 410, 420 and 430 correspond to the flicker characteristic reduction interval 310, the maximum power supply interval 312, and the fixing interval 314, respectively.

After operation 430, the non-heating control unit determines whether print data has been provided while stand-by mode determination time elapses. When it is determined that no print data has been provided while the stand-by mode determination time elapses, the non-heating control unit switches the printing apparatus to a stand-by mode.

Accordingly, the non-heating control determines whether print data has been provided after the printing apparatus is switched to the stand-by mode. When it is determined that the print data has been provided after the printing apparatus is switched to the stand-by mode, the non-heating control unit switches the printing apparatus to printing mode and orders the power supply unit 210 to perform operation 410.

Figure 5:
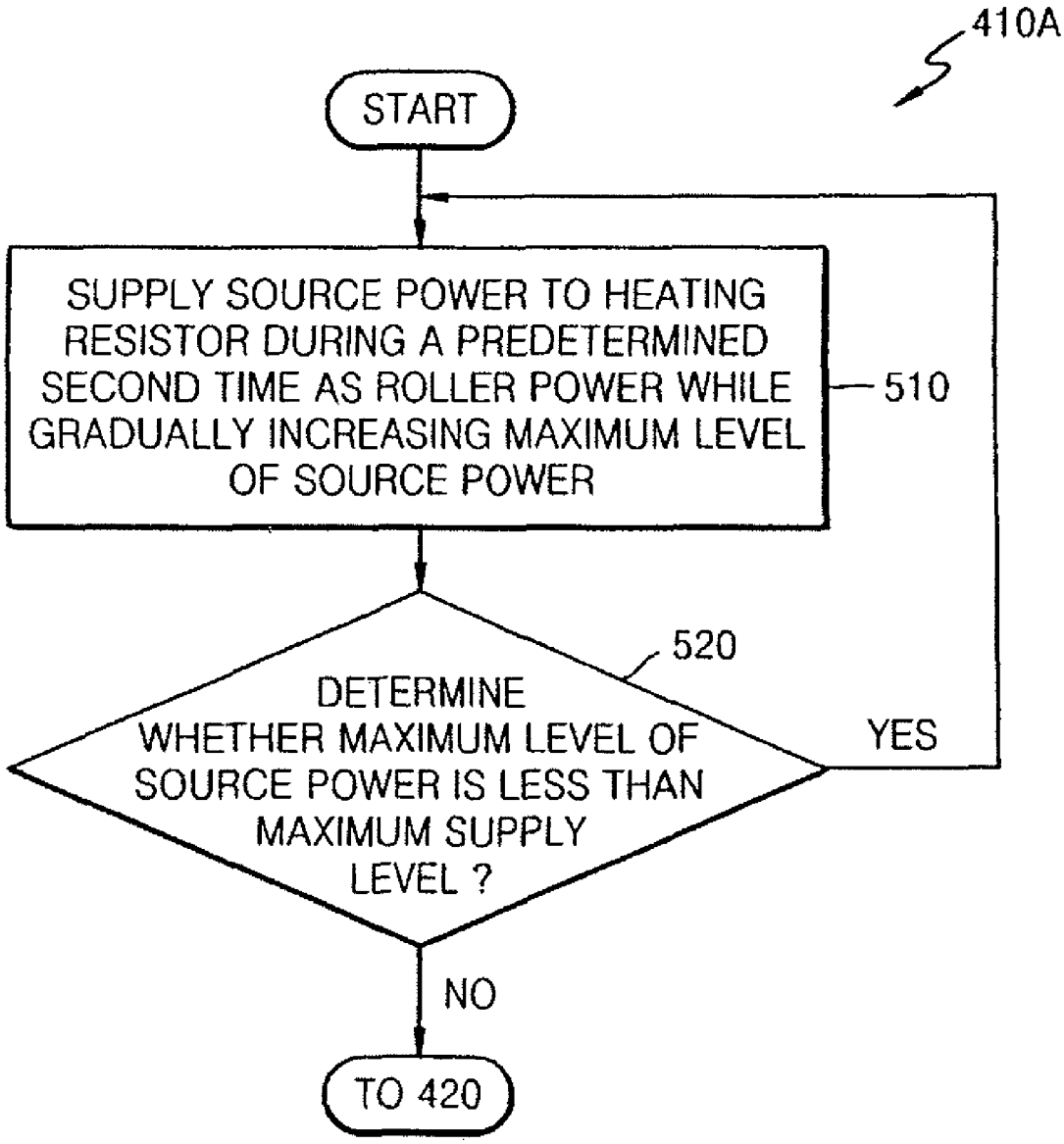
FIG. 5 is a flowchart illustrating a stage of supplying source power while increasing a maximum level of source power illustrated in FIG. 4 according to an embodiment of the present general inventive concept.

FIG. 5 is a flowchart of operation 410 illustrated in FIG. 4, according to an embodiment 410A of the present general inventive concept. Operation 410 includes operations 510 and 520, in which the source power is supplied to the heating resistor as the roller power while the maximum level of the source power is gradually increased up to the maximum supply level.

Referring to FIGS. 2 through 5, the power supply unit 210 supplies the source power to the heating resistor as the roller power during the second time period of the first time period while gradually increasing a maximum level of the source power up to the maximum supply unit in operation 510. In operation 520, the first examination unit 240 determines whether the maximum level of the source power supplied in stage 510 is less than the maximum supply level.

When the maximum level of the source power supplied in operation 510 is determined to be less than the maximum supply level in operation 520, operation 510 is to be performed. In contrast, when the maximum level of the source power supplied in operation 510 is determined to be equal to or larger than the maximum supply level in operation 520, operation 420 is to be performed.

Figure 6:
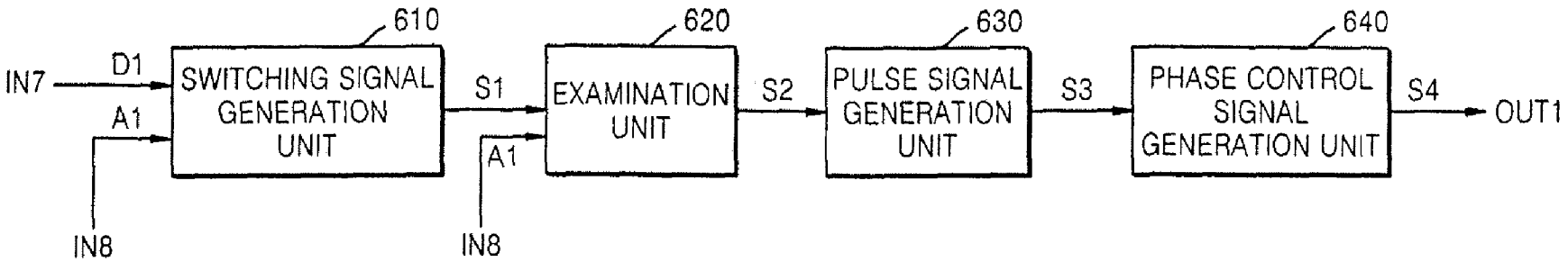
FIG. 6 is a block diagram illustrating a method of generating a phase control signal.
Figure 7:
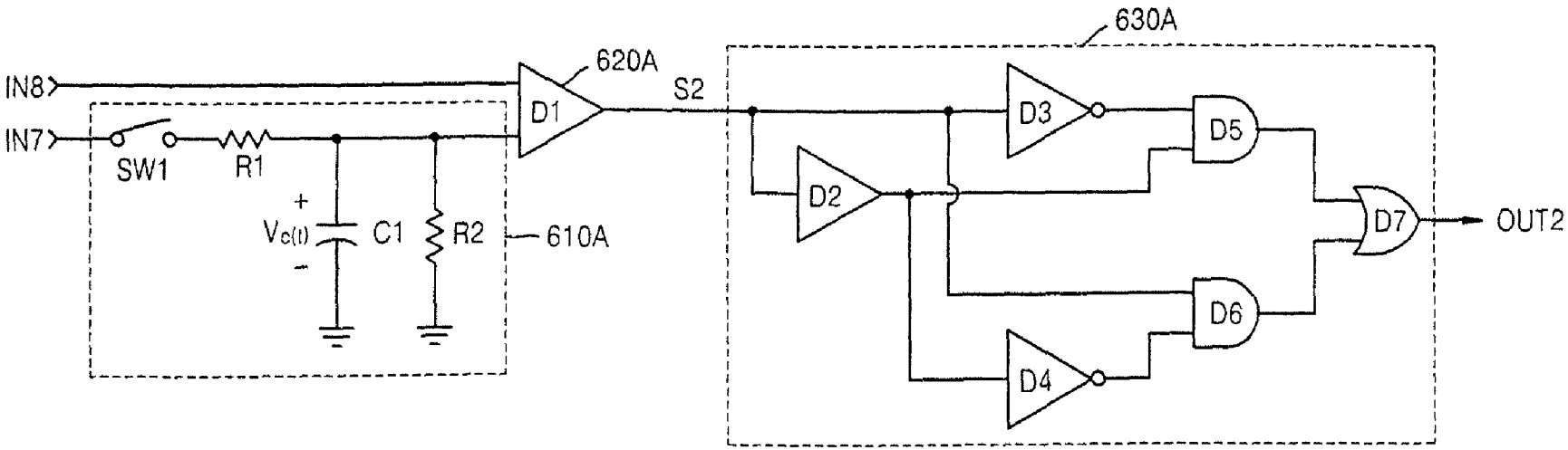
FIG. 7 is a circuit diagram illustrating a switching signal generation unit, an examination unit, and a pulse signal generation unit illustrated in FIG. 6 according to an embodiment of the present general inventive concept.

FIG. 6 is an exemplary block diagram illustrating a method of generating a phase control signal, and the diagram includes a switching signal generation unit 610, an examination unit 620, a pulse signal generation unit 630, and a phase control signal generation unit 640. Reference numbers 610A, 620A, and 630A indicated in FIG. 7 are embodiments of the switching signal generation unit 610, the examination unit 620, and the pulse signal generation unit 630, respectively. Accordingly, FIG. 7 is a diagram of an embodiment of a circuit to implement the switching signal generation unit 610, the examination unit 620, and the pulse signal generation unit 630.

Figures 8A, 8B, 8C, 8D:
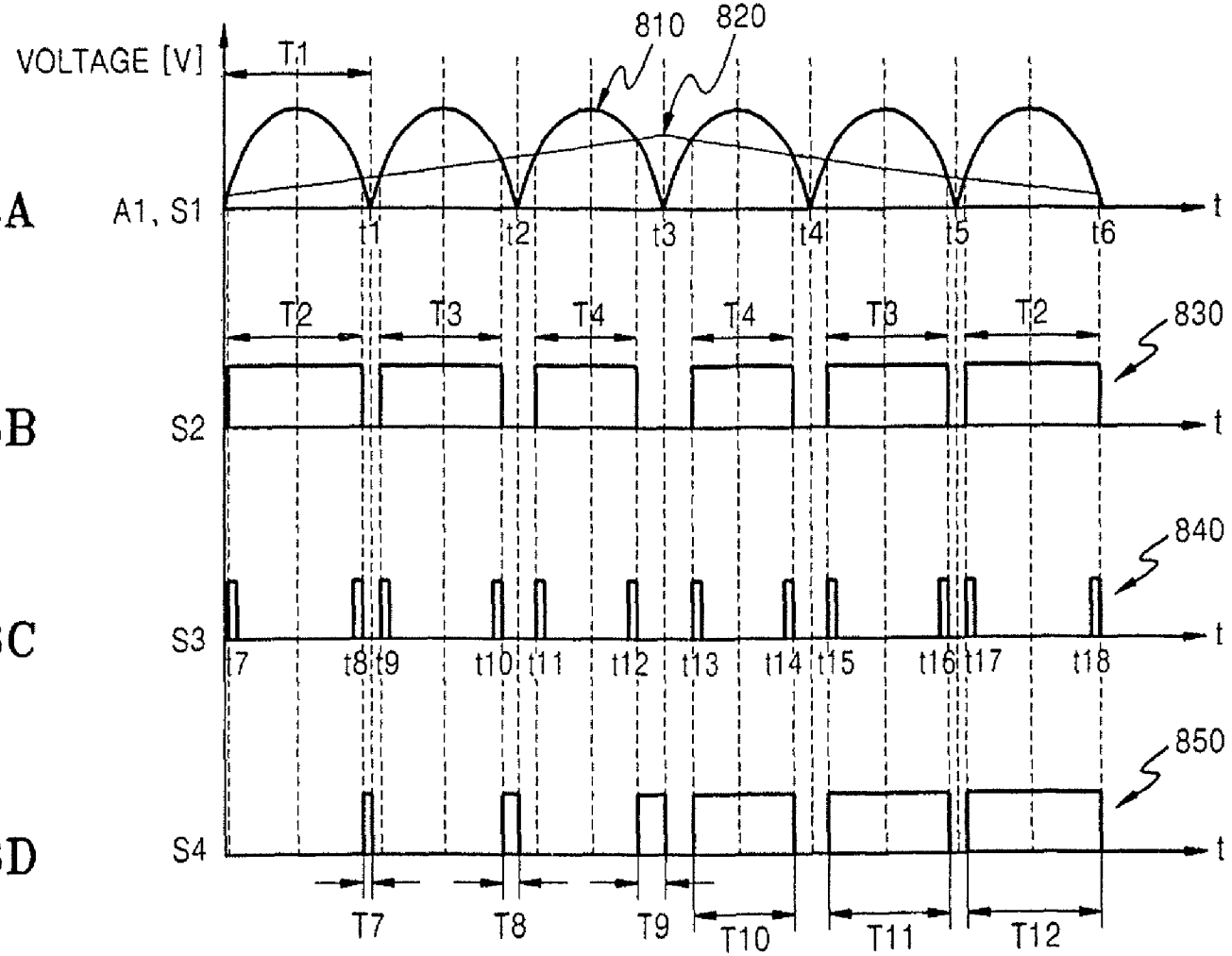
FIGS. 8A through 8D are waveform diagrams illustrating the method illustrated in FIG. 6.

FIG. 8A is an example of a sine wave (A1) 810 which represents an AC voltage having a sinusoidal waveform. FIGS. 8A and 8B represent examples of a switching signal (S1) 820 and a comparison signal (S2) 830, respectively. FIGS. 8C and 8D represent examples of a pulse signal (S3) 840 and a phase control signal (S5) 850, respectively.

Referring to FIGS. 6 through 8D, the switching signal generation unit 610 may include a switch SW1, one or more resistors R1 and R2, and one or more capacitors C1. The switching signal generation unit 610 turns the switch SW1 on and/or off every period that is three times T1, which is half a predetermined second period that is six times T1. Accordingly, the switch SW1 is turned on and/or off alternatively. When the switch SW1 is closed, a direct voltage D1 input through an input terminal IN7 results in charged in the capacitor C1, and the charged capacitor C1 is discharged when the switch SW1 is opened. The switching signal (S1) 820 which is a sine wave including the predetermined second period that is six times T1, is generated in the capacitor C1 according to the periodical turning on and/or off of the switch SW1. An induced voltage Vc(t) across the capacitor C1 represents the switching signal (S1) 820. The switching signal (S1) 820 may be synchronized with the sine wave (A1) 810 which is input through an input terminal IN8 and has the predetermined first period T1. To synchronize the sine wave (A1) 810 with the switching signal (S1) 820, the switching signal generation unit 610 may open or close the switch SW1 when a level of the sine wave (A1) 810 is zero, that is, at a plurality of times 0, t1, t2, t3, t4, t5, and t6.

The examination unit (D1) 620 compares levels of the switching signal (S1) 820 and the sine wave (A1) 810. Accordingly, the examination unit 620 detects an interval during which the level of the sine wave (A1) 810 is higher than the level of the switching signal (S1) 820 and outputs the comparison signal 830 corresponding to the comparison of the signal levels, which has a signal interval the same as the detected interval. As illustrated in FIGS. 8, T2, T3, and T4 are related to each other as follows, T2>T3>T4.

The pulse signal generation unit 630 may include a buffer D2 to delay a signal, one or more inverters D3 and D4 to invert a signal, one or more logic multiplication gates or AND gates D5 and D6, and a logic sum gate or OR gates D7. The pulse signal generation unit 630 can output a pulse signal (S3) 840 to an output terminal OUT2 by generating a pulse when the comparison signal (S2) 830 enters into a non-signal interval from a signal interval, that is, at a plurality of times t8, t10, t12, t14, t16, and t18, respectively, and when the comparison signal (S2) 830 enters into a signal interval from a non-signal interval, that is, at a plurality of times t7, t9, t11, t13, t15, and t17, respectively. The signal interval is a point where the comparison signal 830 begins the pulse period of, for example, the pulse T1. The non signal interval is a point where the comparison signal 830 ends the pulse period of, for example, the pulse T1.

The phase control signal generation unit 640 generates the phase control signal (S4) 850 which has a signal in an interval from a point of time when the level of the switching signal (S1) 820 matches the level of the sine wave (A1) 810 which is in a decreasing period, based on a result of the comparison of a point of time when the level of the sine wave (A1) 810 becomes zero, that is a plurality of time intervals from t8 to t1, from t10 to t2, or from t12 to t3, and an interval from a point of time when the level of the switching signal (S1) 820 matches the level of the sine wave (A1) 810 which is in an increasing period, based on the result of the comparison of a point of time when the level of the sine wave (A1) 810 becomes zero, that is, at a plurality of time intervals from t13 to t4, from t15 to t5, or from t17 to t6 and outputs the generated phase control signal (S4) 850 from an output terminal OUT1.

The predetermined first period T1 is an example of the predetermined first time described above, and a temporal length of the non-zero signal sections T7, T8, T9, T10, T11, or T12 of the phase control signal (S4) 850 is an example of the predetermined second time.

Figure 9:
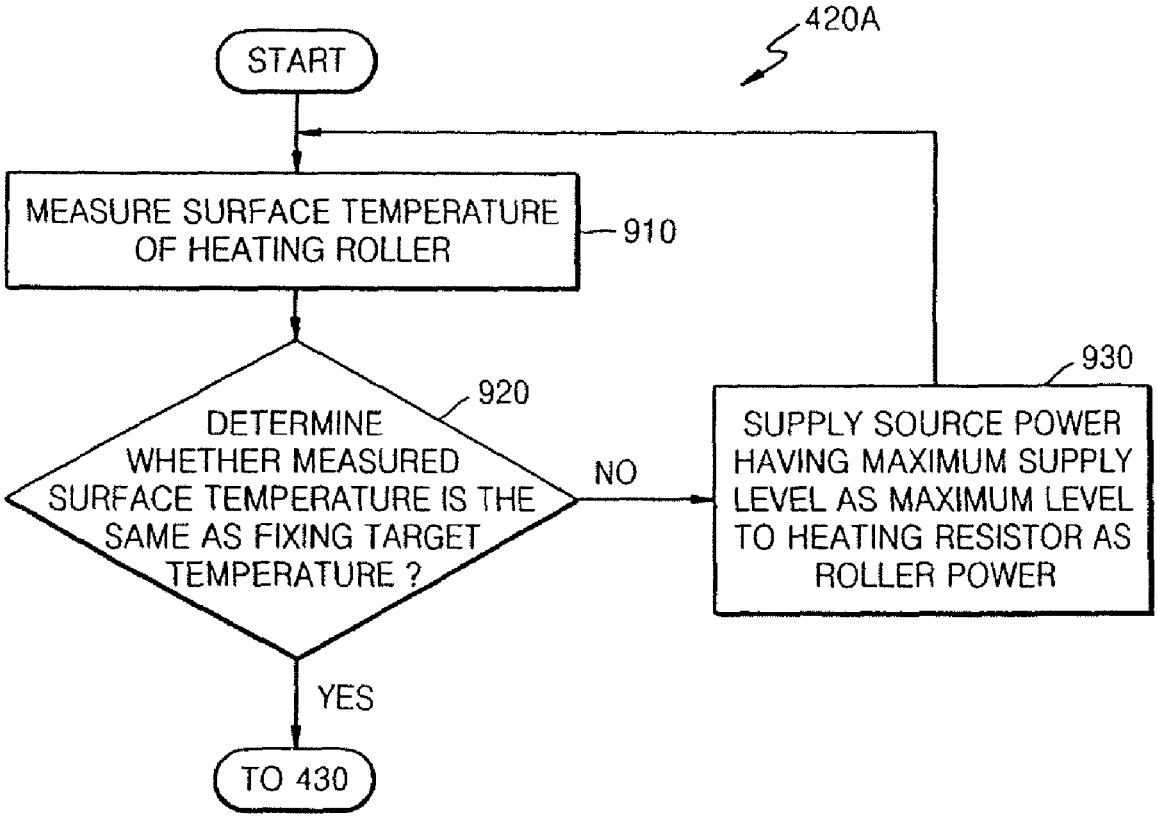
FIG. 9 is a flowchart illustrating a stage of measuring a surface temperature of a heating roller and supplying source power illustrated in FIG. 4 according to an embodiment of the present general inventive concept.

FIG. 9 is a flowchart of operation 420 illustrated in FIG. 4 according to an embodiment 420A of the present general inventive concept. Operation 420 includes operations 910, 920, and 930 in which the source power having the maximum supply level as a maximum level is supplied to the heating resistor until the surface temperature of the heating roller reaches the fixing target temperature.

The temperature measuring unit 220 first measures the surface temperature of the heating roller in operation 910, and the second examination unit 250 determines whether the measured surface temperature in operation 910 is the same as the fixing target temperature in operation 920.

If the measured surface temperature obtained in operation 910 is not the same as the fixing target temperature based on the comparison in operation 920, the power supply unit 210 supplies the source power having the maximum supply level as a maximum level to the heating resistor as the roller power in operation 930.

In contrast, if the measured surface temperature obtained in operation 910 is the same as the fixing target temperature based on the comparison in operation 920, the method of FIG. 9 proceeds to the operation 430.

Figure 10:
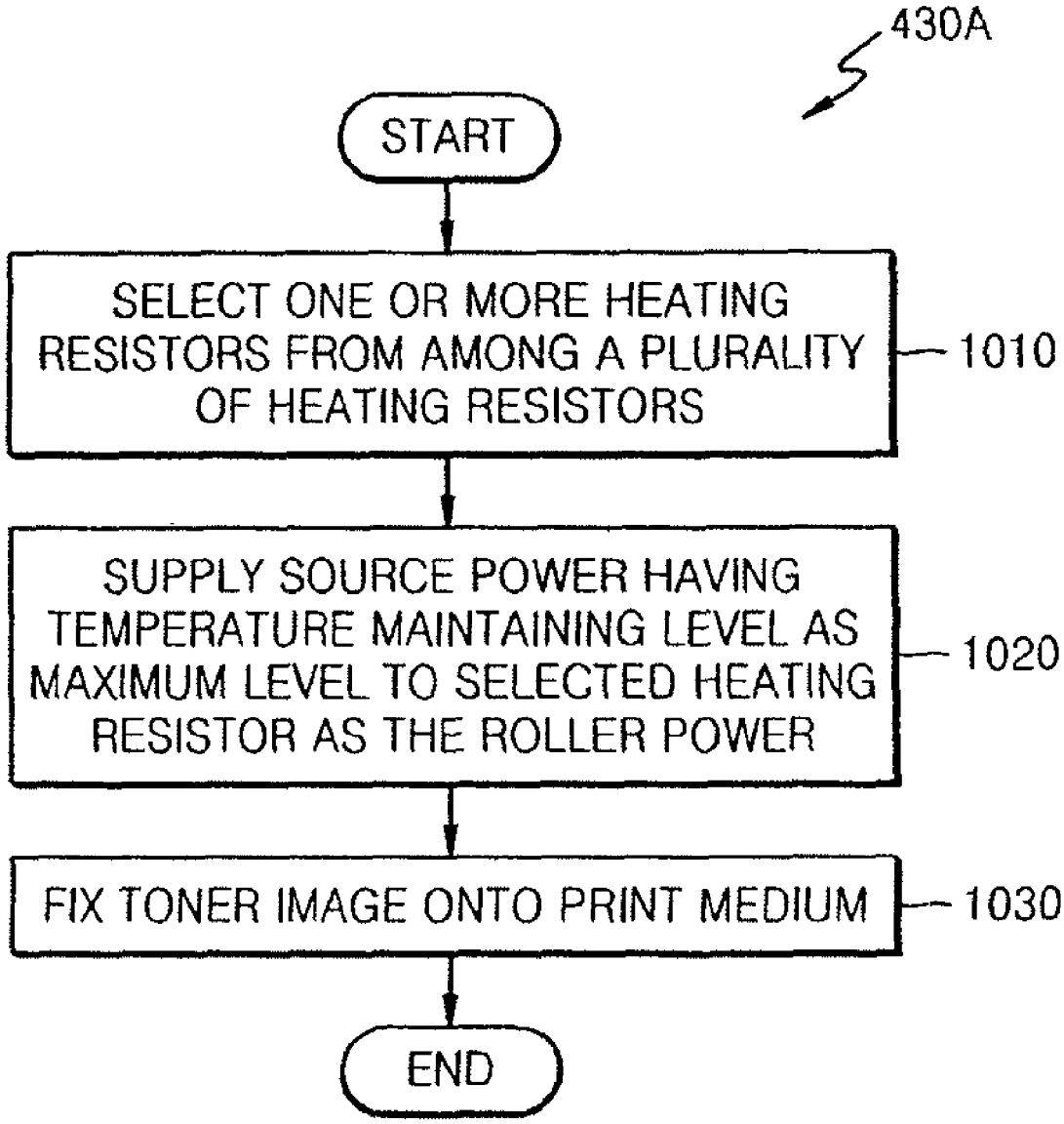
FIG. 10 is a flowchart illustrating a stage of fixing a toner image illustrated in FIG. 4, according to an embodiment of the present general inventive concept.

FIG. 10 is a flowchart of operation 430 illustrated in FIG. 4 according to an embodiment 430A of the present general inventive concept. Operation 430 includes operations 1010, 1020, and 1030, that is, selecting one or more heating resistors, supplying the source power having the maximum temperature maintaining level to the heating resistor and fixing a toner image, respectively.

Referring to FIGS. 2, 4, and 10, the non-heating control unit selects one or more heating resistors from among a plurality of heating resistors included in the heating roller in operation 1010.

In operation 1020, the power supply unit 210 supplies the source power that has the maximum temperature maintaining level to the selected heating resistors as the roller power.

In operation 1030, the toner fixing unit 230 fixes the toner image onto a print medium using the heating roller.

The general inventive concept can also be embodied as computer readable codes on a computer readable medium. The computer readable medium may be a computer readable recording medium and a computer readable transmission medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and so on. The computer readable medium can also be distributed over network coupled computer systems so that the computer readable code is stored and executed in a distributed fashion. The computer readable transmission medium can transmit carrier waves and signals (e.g., wired or wireless data transmission through the Internet).

As described above, the method and apparatus to control power supplied to a heating roller are capable of reducing a flicker characteristic and reaching a fixing target temperature quickly by heating the heating roller before an initialization process of the printing apparatus is completed when the printing apparatus turns on, gradually increasing the power supplied to the heating roller in an initial step, and supplying a maximum power deliverable to the heating roller after a predetermined time elapses.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a phase control circuit to compare levels of a sine wave and a switching signal and generate a phase control signal that has a non-zero value in a signal interval which is determined based on the result of the comparison; and a power supply unit to output source power input from an external source to a heating resistor during the determined signal interval according to the generated phase control signal.

2. The image forming apparatus of claim 1, wherein the determined signal interval is equal to or less than a period of the sine wave and increases as a maximum level of the source power approaches a maximum supply level that can be supplied to the heating resistor.

3. The image forming apparatus of claim 1, wherein the phase control circuit comprises:

a switching signal generation unit to generate the switching signal that increases and decreases repeatedly according to a predetermined second period;

an examination unit to compare levels of the sine wave that has a predetermined first period and the switching signal, and to generate a comparison signal corresponding to the result of the comparison;

a pulse signal generation unit to generate a pulse signal when the level of the comparison signal changes; and a phase control signal generation unit to generate the phase control signal that has a non-zero-value in a gradually increased signal interval using the pulse signal.

4. The image forming apparatus of claim 3, wherein the switching signal generation unit generates the switching signal which synchronized with the sine wave by opening or closing a switch when a level of the sine wave is zero.

5. The image forming apparatus of claim 3, wherein the examination unit further detects an interval which the level of the sine wave is higher than the level of the switching signal, and generates the comparison signal that has a non-zero value in the detected interval.

6. The image forming apparatus of claim 3, wherein the phase control signal generation unit generates the phase control signal that has a non-zero value in the signal interval including a time when the pulse signal generates and a time when a level of the sine wave becomes zero.

7. The image forming apparatus of claim 1, wherein the power supply unit outputs the source power to the heating resistor while gradually increasing a maximum level of the source power in response to a first or second warm-up indication signal and the phase control signal and outputs the source power having a predetermined maximum supply level that can be supplied to the heating resistor as a maximum level to the heating resistor in response to a third warm-up indication signal, the first warm-up indication signal is generated immediately after the image forming apparatus turns on, or immediately after the image forming apparatus is switched into a print mode from a stand-by mode.

8. The image forming apparatus of claim 7, further comprising:

a temperature measuring unit to measure a surface temperature of a heating roller including the hearing resistor in response to the third warm-up indication signal and to output the measured surface temperature; and a toner fixing unit to fix a toner image of print data onto a print medium using the heating roller in response to a fixing indication signal.

9. The image forming apparatus of claim 8, further comprising:

a first examination unit to compare the increased maximum level input from the power supply unit to the predetermined maximum supply level and to generate the second or third warm-up indication signal based on a result of the comparison performed by the first examination unit; and a second examination unit to compare the measured surface temperature to a predetermined fixing target temperature and to generate the third warm-up indication signal or the fixing indication signal based on a result of the comparison performed by the second examination unit.

10. A method of forming an image, the method comprising:

comparing levels of a sine wave and a switching signal;

generating a phase control signal that has a non-zero value in a signal interval which is determined based on the result of the comparison; and outputting source power input from an external source to a heating resistor during the determined signal interval according to the generated phase control signal.

11. The method of claim 10, wherein the determined signal interval is equal to or less than a period of the sine wave and increases as a maximum level of the source power approaches a maximum supply level that can be supplied to the heating resistor.

12. The method of claim 10, further comprising:

generating the switching signal that increases and decreases repeatedly according to a predetermined second period;

comparing levels of the sine wave that has a predetermined first period and the switching signal;

generating a comparison signal corresponding to the result of the comparison;

generating a pulse signal when the level of the comparison signal changes; and generating the phase control signal that has a non-zero-value in a gradually increased signal interval using the pulse signal.

13. The method of claim 12, wherein the generating of the switching signal generates the switching signal which synchronized with the sine wave by opening or closing a switch when a level of the sine wave is zero.

14. The method of claim 12, wherein the comparing of the levels further detects an interval which the level of the sine wave is higher than the level of the switching signal, and the generating of the comparison signal generates the comparison signal that has a non-zero value in the detected interval.

15. The method of claim 12, wherein generating of the phase control signal generates the phase control signal that has a non-zero value in the signal interval including a time when the pulse signal generates and a time when a level of the sine wave becomes zero.

16. The method of claim 10, wherein the outputting of the source power outputs the source power to the heating resistor while gradually increasing a maximum level of the source power in response to a first or second warm-up indication signal and the phase control signal and outputs the source power having a predetermined maximum supply level that can be supplied to the heating resistor as a maximum level to the heating resistor in response to a third warm-up indication signal, the first warm-up indication signal is generated immediately after an image forming apparatus turns on, or immediately after the image forming apparatus is switched into a print mode from a stand-by mode.

17. The method of claim 16, further comprising:

measuring a surface temperature of a heating roller including the hearing resistor in response to the third warm-up indication signal;

outputting the measured surface temperature; and fixing a toner image of print data onto a print medium using the heating roller in response to a fixing indication signal.

18. The method of claim 17, further comprising:

comparing the increased maximum level input from the power supply unit to the predetermined maximum supply level and generating the second or third warm-up indication signal based on a result of the comparison; and comparing the measured surface temperature to a predetermined fixing target temperature and to generate the third warm-up indication signal or the fixing indication signal based on a result of the comparison.

19. A non-transitory computer readable medium having embodied thereon a computer program to perform a method of forming an image, the method comprising:

comparing levels of a sine wave and a switching signal;

generating a phase control signal that has a non-zero value in a signal interval which is determined based on the result of the comparison; and outputting source power input from an external source to a heating resistor during the determined signal interval according to the generated phase control signal.

* * * * *